US010362387B2

(12) United States Patent
Hirai et al.

(10) Patent No.: US 10,362,387 B2
(45) Date of Patent: Jul. 23, 2019

(54) ACOUSTIC RESISTOR, ACOUSTIC RESISTOR MEMBER INCLUDING SAME, AND AUDIO DEVICE INCLUDING SAME

(71) Applicant: NITTO DENKO CORPORATION, Osaka (JP)

(72) Inventors: Bunta Hirai, Osaka (JP); Satoru Furuyama, Osaka (JP); Masaaki Mori, Osaka (JP); Hajime Yamamoto, Osaka (JP)

(73) Assignee: NITTO DENKO CORPORATION, Osaka (JP)

( * ) Notice: Subject to any disclaimer, the term of this patent is extended or adjusted under 35 U.S.C. 154(b) by 0 days.

(21) Appl. No.: 15/552,947

(22) PCT Filed: Feb. 22, 2016

(86) PCT No.: PCT/JP2016/000937
§ 371 (c)(1),
(2) Date: Aug. 23, 2017

(87) PCT Pub. No.: WO2016/136234
PCT Pub. Date: Sep. 1, 2016

(65) Prior Publication Data

US 2018/0020284 A1 Jan. 18, 2018

(30) Foreign Application Priority Data

Feb. 27, 2015 (JP) ..... 2015-037793

(51) Int. Cl.
*H04R 1/10* (2006.01)
*H04R 1/28* (2006.01)

(52) U.S. Cl.
CPC ..... *H04R 1/2811* (2013.01); *H04R 1/10* (2013.01); *H04R 1/28* (2013.01); *H04R 1/2823* (2013.01); *H04R 1/2869* (2013.01)

(58) Field of Classification Search
CPC .. H04R 1/2823; H04R 1/2846; H04R 1/2876; H04R 1/2811; H04R 1/10; H04R 1/28
See application file for complete search history.

(56) References Cited

U.S. PATENT DOCUMENTS 8,670,586 B1 * 3/2014 Boyle ..... H04R 1/1008 381/370
9,171,535 B2 10/2015 Abe et al.
(Continued)

FOREIGN PATENT DOCUMENTS

EP 0825796 2/1998
EP 2583733 4/2013
(Continued)

OTHER PUBLICATIONS

Search Report issued in International Bureau of WIPO Patent Application No. PCT/JP2016/000937, dated May 10, 2016.
(Continued)

*Primary Examiner* — Sunita Joshi
(74) *Attorney, Agent, or Firm* — Greenblum & Bernstein, P.L.C.

(57) ABSTRACT

An acoustic resistor for use in an audio device includes a resin film having air permeability in a thickness direction of the resin film, and the resin film is a non-porous film having through holes formed to extend straight through the resin film in the thickness direction. This acoustic resistor is used in an audio device including: a transducing part that performs conversion between sound and an electrical signal and that includes an acoustic element; a housing enclosing the transducing part and having at least one opening; and a passage for gas that is present inside the housing and communicates with the opening and in which the acoustic element is placed. The acoustic resistor is placed between the opening and the acoustic element in the passage. The
(Continued)

variation in properties of the acoustic resistor of the present disclosure can be made smaller than that of conventional acoustic resistors.

16 Claims, 6 Drawing Sheets

(56) References Cited

U.S. PATENT DOCUMENTS

| | | | | |
|---|---|---|---|---|
| 2004/0125975 | A1 | 7/2004 | Suzuki et al. | |
| 2013/0333978 | A1* | 12/2013 | Abe | G10K 11/002 181/291 |

FOREIGN PATENT DOCUMENTS

| | | |
|---|---|---|
| GB | 2187361 | 9/1987 |
| JP | 8-205289 | 8/1996 |
| JP | 2004-200947 | 7/2004 |
| JP | 2006-50174 | 2/2006 |
| JP | 2012-195928 | 10/2012 |

OTHER PUBLICATIONS

Official Communication issued in European Patent Office (EPO) Patent Application No. 16754985.6, dated Sep. 17, 2018.

* cited by examiner

ACOUSTIC RESISTOR, ACOUSTIC RESISTOR MEMBER INCLUDING SAME, AND AUDIO DEVICE INCLUDING SAME

TECHNICAL FIELD

The present invention relates to an acoustic resistor responsible for the sound characteristics of an audio device, an acoustic resistor member including the acoustic resistor, and an audio device including the acoustic resistor.

BACKGROUND ART

Audio devices such as microphones, speakers, earphones, and headphones include: a transducing part that performs conversion between sound and an electrical signal; and a housing enclosing the transducing part. The transducing part includes an acoustic element, such as a vibration plate, which sends and/or receives sound. The acoustic element may be exposed to the outside of the housing as with the case of common speakers, or may be enclosed within the housing as with the case of earphones and microphones. When the acoustic element is enclosed within the housing, the housing is provided with a sound transmission port which is an opening for transmission of sound between the acoustic element and the outside of the housing.

The housing of an audio device is typically provided with an opening other than the sound transmission port, except when the housing is intentionally designed not to have such an opening. If the acoustic element is exposed to the outside of the housing but the housing itself is sealed, or if a space between the acoustic element and the sound transmission port is open to the outside through the sound transmission port but the opposite space in the housing is sealed, the pressure in the sealed space varies with the movement of the acoustic element. The pressure variation disturbs the vibration of the acoustic element and thereby deteriorates the sound output characteristics and/or sound input characteristics of the audio device (these characteristics may hereinafter be simply referred to as "audio device characteristics"), unless the audio device is delicately designed. The influence of the pressure variation is great when the volume of the sealed space is particularly small relative to the size of the acoustic element, such as in earphones. Providing the housing with an opening other than the sound transmission port can prevent such a sealed condition, leading to an improvement in the vibration characteristics of the acoustic element and therefore an improvement in the audio device characteristics.

In some audio devices, an acoustic resistor is disposed in an air passage between an acoustic element and housing openings including a sound transmission port. The acoustic resistor, although having air permeability, acts as an airflow resistor in the presence of which the air movement in the passage becomes more disturbed than in its absence. The placement of the acoustic resistor allows control of the air movement in the passage. Since sound is a vibration of air, the placement of the acoustic resistor between the acoustic element and the sound transmission port allows control of the characteristics of sound sent from the acoustic element and/or sound received by the acoustic element and therefore control of the audio device characteristics. In addition, the placement of the acoustic resistor between an opening other than the sound transmission port and the acoustic element allows control of air movement acting on the side of the acoustic element facing the opening, thus allowing control of the vibration of the acoustic element and therefore control of the characteristics of sound sent from the acoustic element and/or sound received by the acoustic element.

Patent Literatures 1 to 3 each disclose an audio device in which an acoustic resistor is placed. The acoustic resistors disclosed in these literatures are formed of a porous body such as a sponge, of a non-woven fabric, or of a woven fabric such as a mesh.

CITATION LIST

Patent Literature

Patent Literature 1: JP H8(1996)-205289 A
Patent Literature 2: JP 2004-200947 A
Patent Literature 3: JP 2006-50174 A

SUMMARY OF INVENTION

Technical Problem

It is desired for acoustic resistors to be such that variation in properties such as variation in air permeability is small. If the variation is large, the characteristics such as sound pressure characteristics of audio devices including the acoustic resistors will also vary. This is problematic in terms of product-to-product variation in characteristics when the audio devices are those including a single transducing part and a single housing. This problem is particularly serious in the case of an audio device such as an earphone set or headphone set which includes a plurality of units, such as a left unit and a right unit, each of which includes a transducing part and a housing. A large difference in output characteristics such as sound pressure characteristics between the units can preclude the use of the audio device in the form of an earphone set or headphone set constructed of the pair of units.

An object of the present invention is to provide: an acoustic resistor whose variation in properties can be made smaller than that of conventional acoustic resistors; an acoustic resistor member including the acoustic resistor; and an audio device including the acoustic resistor.

Solution to Problem

The acoustic resistor of the present disclosure is an acoustic resistor for use in an audio device. The audio device includes: a transducing part that performs conversion between sound and an electrical signal, the transducing part including an acoustic element that sends and/or receives the sound; and a housing enclosing the transducing part and having at least one opening. The audio device has a passage for gas, the passage being present inside the housing and communicating with the at least one opening. The acoustic element is placed in the passage. The acoustic resistor is adapted to be placed between the at least one opening and the acoustic element in the passage, and includes a resin film having an air permeability in a thickness direction of the resin film. The resin film is a non-porous film having through holes formed to extend straight through the resin film in the thickness direction.

The acoustic resistor member of the present disclosure includes the above acoustic resistor of the present disclosure and a supporting member joined to the acoustic resistor.

The audio device of the present disclosure includes: a transducing part that performs conversion between sound and an electrical signal, the transducing part including an acoustic element that sends and/or receives the sound; a housing enclosing the transducing part and having at least one opening; and a passage for gas, the passage being present inside the housing and communicating with the at least one opening, the acoustic element being placed in the passage, the audio device further including an acoustic resistor placed between the at least one opening and the acoustic element in the passage, the acoustic resistor including a resin film having an air permeability in a thickness direction of the resin film. The acoustic resistor is the above acoustic resistor of the present disclosure.

Advantageous Effects of Invention

The present invention can provide: an acoustic resistor whose variation in properties can be made smaller than that of conventional acoustic resistors; an acoustic resistor member including the acoustic resistor; and an audio device including the acoustic resistor.

DESCRIPTION OF EMBODIMENTS

Figure 1:
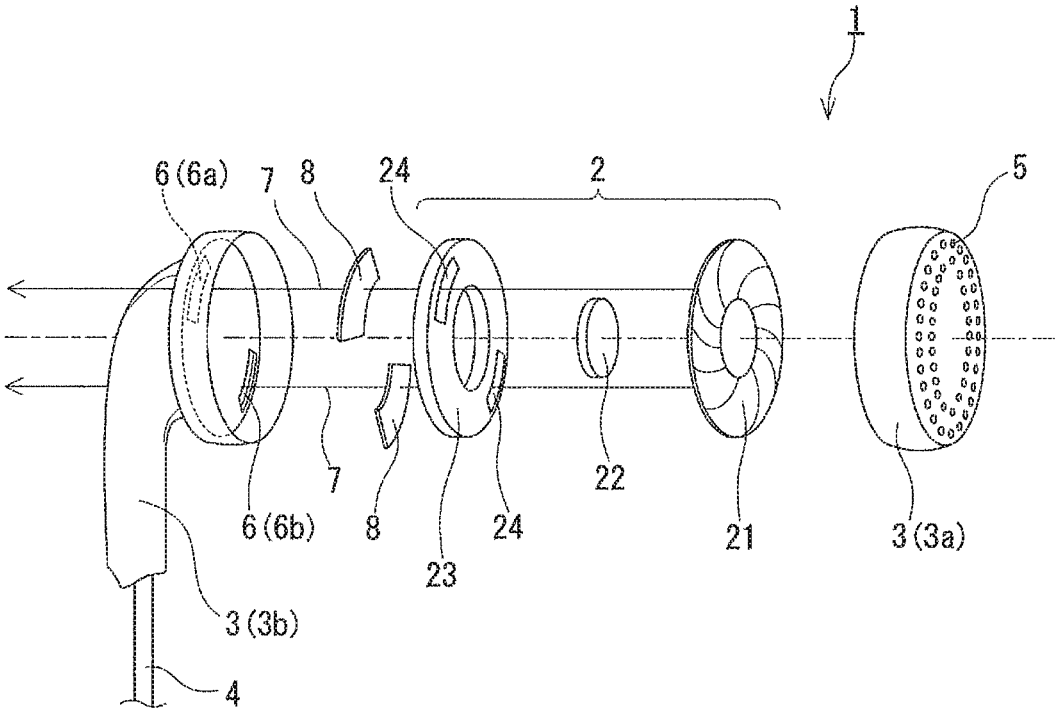
FIG. 1 is an exploded perspective view schematically showing an exemplary audio device including the acoustic resistor of the present invention.

The first aspect of the present disclosure provides an acoustic resistor for use in an audio device, the audio device including: a transducing part that performs conversion between sound and an electrical signal, the transducing part including an acoustic element that sends and/or receives the sound; a housing enclosing the transducing part and having at least one opening; and a passage for gas, the passage being present inside the housing and communicating with the at least one opening, the acoustic element being placed in the passage, the acoustic resistor being adapted to be placed between the at least one opening and the acoustic element in the passage, the acoustic resistor including a resin film having an air permeability in a thickness direction of the resin film, the resin film being a non-porous film having through holes formed to extend straight through the resin film in the thickness direction.

The second aspect of the present disclosure provides the acoustic resistor as set forth in the first aspect, wherein the through holes have a diameter of 3.0 μm or more and 13.0 μm or less.

The third aspect of the present disclosure provides the acoustic resistor as set forth in the first or second aspect, wherein the acoustic resistor is placed to cover a cross-section of the passage.

The fourth aspect of the present disclosure provides the acoustic resistor as set forth in any one of the first to third aspects, further including a liquid-repellent layer.

The fifth aspect of the present disclosure provides an acoustic resistor member including: the acoustic resistor as set forth in any one of the first to fourth aspects; and a supporting member joined to the acoustic resistor.

The sixth aspect of the present disclosure provides an audio device including: a transducing part that performs conversion between sound and an electrical signal, the transducing part including an acoustic element that sends and/or receives the sound; a housing enclosing the transducing part and having at least one opening; and a passage for gas, the passage being present inside the housing and communicating with the at least one opening, the acoustic element being placed in the passage, the audio device further including an acoustic resistor placed between the at least one opening and the acoustic element in the passage, the acoustic resistor including a resin film having an air permeability in a thickness direction of the resin film, the acoustic resistor being the acoustic resistor as set forth in any one of the first to fourth aspects.

The seventh aspect of the present disclosure provides the audio device as set forth in the sixth aspect, wherein the housing has the two or more openings, the two or more openings include a sound transmission port for transmission of the sound between the acoustic element and the outside of the housing, and the acoustic resistor is placed at least in the passage communicating with the opening other than the sound transmission port.

The eighth aspect of the present disclosure provides the audio device as set forth in the sixth or seventh aspect, being an earphone set, an earphone unit, a headphone set, a headphone unit, a headset, a headset unit, a telephone receiver, a hearing aid, or a wearable terminal.

[Acoustic Resistor]

FIG. 1 shows an exemplary audio device including the acoustic resistor of the present invention. The audio device shown in FIG. 1 is an earphone unit 1 for constituting one-half (right-ear or left-ear portion) of an earphone set. The earphone unit 1 is an example of the audio device of the present invention.

The earphone unit 1 includes: a transducing part 2 including a vibration plate 21 serving as an acoustic element that sends sound; a front housing 3*a*; and a rear housing 3*b*. The transducing part 2 is placed between the front housing 3*a* and the rear housing 3*b* which are assembled as a housing 3 of the unit 1. The transducing part 2 includes the vibration plate 21, a magnet 22, and a frame 23, which are assembled together. The vibration plate 21 is a circular film, and a cylindrical coil is disposed on a surface (rear surface) of the vibration plate 21 that is opposite to the surface (front surface) seen in the figure. The magnet 22 is circular and, when the transducing part 2 is assembled, the magnet 22 is placed inside the opening portion of the coil disposed on the rear surface of the vibration plate 21 and inside the opening portion of the frame 23 of ring shape. The vibration plate 21 is joined at its peripheral portion to the frame 23, and the portion (main portion) of the vibration plate 21 other than the peripheral portion can freely vibrate in response to the movement of the coil. Upon delivery of an electrical signal (electrical signal carrying sound information; sound signal) to the transducing part 21, a current corresponding to the signal flows in the coil to induce electromagnetic interaction between the current and the magnet 22. The electromagnetic interaction causes the vibration plate 21 to undergo a physical vibration corresponding to the sound signal, and this vibration is sent in the form of sound from the vibration plate 21. That is, the transducing part 2 functions as a transducer that converts an electrical signal carrying sound information to sound. The electrical signal to be delivered to the transducing part 2 is fed to the coil ring on the rear surface of the vibration plate 21 through a cable 4 connected to the rear housing 3*b* of the unit 1. The electrical connection between the cable 4 and the coil is not shown in the drawings.

The housing(s) 3 (3*a*, 3*b*) of the unit 1 has (have) openings. The openings include a sound transmission port 5 provided in the front housing 3*a*. The sound sent from the front surface of the vibration plate 21 is transmitted to the outside of the unit 1 through the sound transmission port 5. The openings further include openings 6 provided in the rear housing 3*b*. The rear housing 3*b* has two openings 6*a* and 6*b*.

In the housing 3 of the unit 1 there is a passage 7 for gas (air in the case of a typical usage environment) that communicate with the opening 6*a* or 6*b*. The passage 7 extends from the opening 6*a* or 6*b* to the rear surface of the vibration plate 21 through at least one opening 24 provided in the frame 23. That is, the vibration plate 21 serving as an acoustic element is disposed at an end of the passage 7 (the end remote from the opening 6*a* or 6*b*). In FIG. 1, the passage 7 is shown in the form of a straight line for ease of understanding. However, given that the passage 7 is a gas passage, it should be understood that any region in the housing 3 with which a gas can communicate through the opening 6*a* or 6*b* can serve as the passage 7. In the unit 1, an acoustic resistor 8 is placed between the opening 6*a* or 6*b* and the vibration plate 21 in the passage 7. Specifically, the acoustic resistor 8 has a shape corresponding to a part of a ring and conforming to the shape of the opening 24 of the frame 23 and is joined to the frame 23 to cover the opening 24. In the unit 1 shown in FIG. 1, the passage 7 always passes through the acoustic resistor 8. It can be said that the acoustic resistor 8 is placed in the unit 1 so as to cover a cross-section of the passage 7.

The acoustic resistor 8 is composed of a resin film 81 having an air permeability in its thickness direction. The resin film 81 is a non-porous film having through holes formed to extend straight through the film in the thickness direction thereof.

The provision of the gas passage 7 extending from the acoustic element to the opening 6 can, for example, prevent disturbance of movement (vibration) of the vibration plate 21 serving as the acoustic element. This effect is particularly significant in the earphone unit 1, because the internal volume of the housing 3, especially the volume of the region opposite to the sound transmission port 5 with respect to the vibration plate 21 (the region between the rear surface of the vibration plate and the rear housing), is small. The placement of the acoustic resistor 8 serving as a resistance to the flow of a gas traveling in the passage 7 improves the characteristics of sound output from the earphone unit 1 which is an audio device and therefore the characteristics of sound output from an earphone set including the unit 1. An example of the characteristics to be improved is the sound quality of the earphone unit 1 and an earphone set including the earphone unit 1. Specific examples of improvements in sound quality include: output of sound in exact accordance with sound signals input to the transducing part 2; reduction in undesired resonance; flattening of the frequency characteristics of output sound; amplification or attenuation of output sound in a certain frequency range; and achievement of directionality or non-directionality. The same improvements in characteristics can be achieved for sound-emitting audio devices other than the earphone unit shown as an example in FIG. 1. Also for sound-receiving audio devices such as a microphone, the corresponding improvements in characteristics can be achieved.

For the acoustic resistor 8 including the resin film 81, variations (variations in characteristics and/or structure, such as variation in air permeability) are smaller than for conventional acoustic resistors which are composed of a porous body such as a sponge, of a non-woven fabric, or of a woven fabric such as a mesh. The variations include all of the following: variation within the surface of one acoustic resistor; variation between two or more acoustic resistors disposed in an audio device (with the exception of when the characteristics such as air permeability and/or the structure is intentionally varied between the acoustic resistors); and variation between acoustic resistors which are respectively included in two or more units used for one device (the units are, for example, left and right earphone units of an earphone set). The fact that such variations are small offers, for example, the following advantage.

That is, the above-described effects, in particular the improvements in audio device characteristics, which are provided by the provision of the passage 7 and the placement of the acoustic resistor 8 in the passage 7, can be more reliably achieved. In addition, the flexibility in designing audio devices to adjust or improve their characteristics is increased.

Reduced variation within one acoustic resistor and reduced variation between two or more acoustic resistors disposed in an audio device lead, for example, to a further improvement in audio device characteristics (such as, in particular, sound pressure characteristics). Additionally, for example, in manufacturing of audio devices, it is possible to simplify or skip the step of sorting out acoustic resistors with as small variation as possible or the steps conventionally performed to reduce variation within one acoustic resistor or among acoustic resistors as much as possible on the assumption that there is inevitably some degree of variation. Examples of the steps conventionally performed include: the step of adjusting the shape of acoustic resistors; the step of adjusting how acoustic resistors are placed in audio devices; the step of adjusting how acoustic resistors are joined to other members constituting audio devices; and the step of accurately testing the characteristics of the produced audio devices. Simplifying or skipping these steps leads to an increase in production yield of audio devices and a decrease in production cost of the audio devices. For an audio device such as an earphone set constructed of a combination of two or more units, reduced variation between the acoustic resistors respectively included in the units can, for example, result in reduced variation in output characteristics between the units. This, for example, makes it possible to simplify or skip the step of sorting out and combining left and right units having similar or identical output characteristics in manufacturing of earphone sets. In addition, the reduced variation in output characteristics between earphone units presents the possibility of allowing each earphone unit to be sold alone as a manufacturing part or replacement part, although persons skilled in the art have traditionally taken it for granted that a single earphone unit cannot be sold alone due to variation in output characteristics. This possibility is of great significance.

Besides, the acoustic resistor 8 including the non-porous resin film 81 having through holes extending straight through the thickness of the film 81 can have dustproofness. The acoustic resistor 8 having dustproofness shows a function as a dustproof member in addition to the above function of improving the characteristics of an audio device. The placement of such an acoustic resistor 8 in the passage 7 can, for example, prevent entry of foreign matters such as dust into the housing 3 of the audio device through the opening 6, thus allowing the audio device to have dustproof properties. The level of dustproofness of the acoustic resistor 8 can be controlled, for example, by adjusting the diameter of the through holes of the resin film 81.

Waterproofness can be imparted to the acoustic resistor 8, for example, by forming a liquid-repellent layer on the resin film 81. The acoustic resistor 8 having waterproofness shows a function as a waterproof member in addition to the above function of improving the characteristics of an audio device. The placement of such an acoustic resistor 8 in the passage 7 can, for example, prevent entry of water into the housing 3 of the audio device through the opening 6, thus allowing the audio device to have waterproof properties. The level of waterproofness of the acoustic resistor 8 can be controlled, for example, by adjusting the configuration of the liquid-repellent layer and the diameter of the through holes of the resin film 81.

The acoustic resistor 8 can have both dustproofness and waterproofness.

Depending on its material, the acoustic resistor 8 can have higher stability over time than conventional acoustic resistors. In some cases, for example, a porous body made of urethane foam is used as an acoustic resistor; however, the stability over time of such an acoustic resistor is by no means satisfactory, since the urethane resin is hydrolyzable by atmospheric moisture. By contrast, the acoustic resistor 8 including the resin film 81 made of, for example, polyethylene terephthalate (PET) exhibits much higher stability over time.

Figure 2:
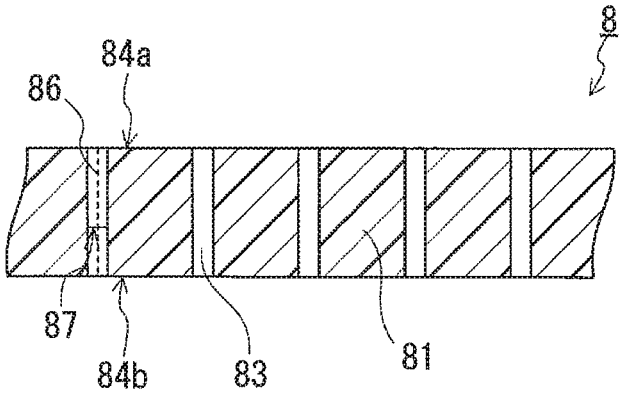
FIG. 2 is a cross-sectional view schematically showing an example of the acoustic resistor of the present invention.

FIG. 2 shows an example of the acoustic resistor 8. The acoustic resistor 8 shown in FIG. 2 consists of the resin film 81. The resin film 81 has through holes 83 formed to extend through the thickness of the resin film 81. The through holes 83 extend from a first principal surface 84*a* of the resin film 81 to a second principal surface 84*b* of the resin film 81. The resin film 81 is a non-porous resin film and has no passage that allows through-thickness air permeation other than the through holes 83. The resin film 81 is typically an imperforate (solid) resin film except for the through holes 83. The through holes 83 have openings at both principal surfaces of the resin film 81. Such a configuration of the resin film 81 makes it possible to achieve small variation in properties of the acoustic resistor 8 such as small variation in air permeability.

The through holes 83 are straight holes having a central axis (axial line) 86 extending straight. The through holes 83 can be formed as straight holes, for example, by ion beam irradiation and subsequent chemical etching of an original film which is a resin film. With the combination of ion beam irradiation and etching, a number of through holes 83 having more uniform diameters (opening diameters) can be formed in the resin film 81. The resin film 81 can be a film obtained by ion beam irradiation and chemical etching of an original film. The high uniformity in diameter of the through holes 83 in the acoustic resistor 8 contributes to small variation in properties of the acoustic resistor 8 such as small variation in air permeability. In FIG. 2 and the subsequent figures illustrating the structure of an acoustic resistor, the diameters of through holes are exaggeratedly shown to make it easy to understand the shape of the through holes.

In the example shown in FIG. 2, the direction in which the through holes 83 extend is perpendicular to the principal surfaces 84*a* and 84*b* of the resin film 81. The direction in which the through holes 83 extend may be oblique to the direction perpendicular to the principal surfaces 84*a* and 84*b* of the resin film 81, as long as the through holes 83 pierce the resin film 81 in its thickness direction. All of the through holes 83 present in the resin film 81 may extend in the same direction (namely, the directions of the central axes 86 may be identical). Alternatively, as shown in FIG. 3, the resin film 81 may have through holes 83 (83*a* to 83*g*) extending in oblique directions with respect to the direction perpendicular to the principal surfaces 84*a* and 84*b* of the film, the through holes including a through hole extending in a first oblique direction with respect to the perpendicular direction and a through hole extending in a second oblique direction with respect to the perpendicular direction, the first and second oblique directions being different from each other.

Figure 3:
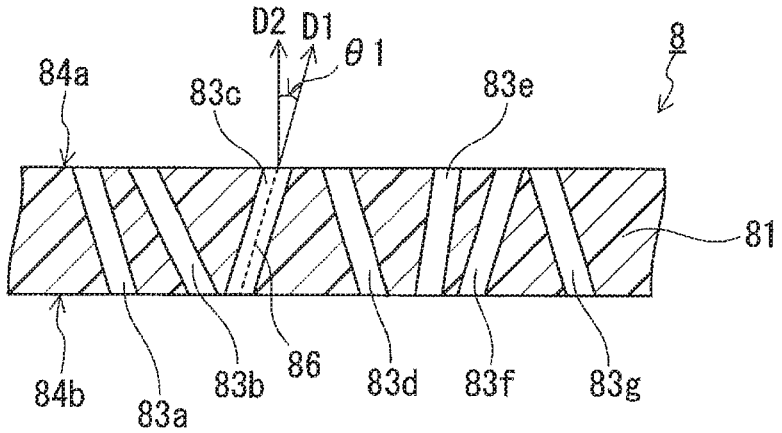
FIG. 3 is a cross-sectional view schematically showing another example of the acoustic resistor of the present invention.

In the example shown in FIG. 3, there is a combination of through holes 83 extending (penetrating through the resin film 81) in the first oblique direction with respect to the direction perpendicular to the principal surfaces 84*a* and 84*b* of the resin film 81 and through holes 83 extending in the second oblique direction with respect to the perpendicular direction. In this case, the resin film 81 may have a combination of through holes 83 extending in the same oblique direction (the through holes 83*a*, 83*d*, and 83*g* extend in the same direction in the example shown in FIG. 3). The resin film 81 may have both a through hole 83 extending in the direction perpendicular to the principal surfaces 84*a* and 84*b* of the film and a through hole 83 extending obliquely to the perpendicular direction. The term "set" may hereinafter be used instead of "combination". The term "set" is used not only to refer to the relationship (a pair) between one through hole and another through hole but also to refer to the relationship between one or more through holes and one or more other through holes. Saying that there is a set of through holes having the same features means that there are two or more through holes having the features.

In the acoustic resistor 8 as shown in FIG. 3 which includes the resin film 81 in which the through holes 83 extending in different oblique directions coexist, the oblique angles and the proportion of the through holes 83 extending in each direction can be varied. Thus, in this case, the resistance to gas flow in the passage 7 can be varied more widely, or in a different range, than in the case of an acoustic resistor 8 that does not have the configuration as shown in FIG. 3. This allows a further increased flexibility in controlling the characteristics of an audio device by the use of the resistor 8. The high flexibility contributes to an improvement in the characteristics of the audio device and to an increase in flexibility in design of the audio device.

For the through holes 83 shown in FIG. 3, the angle θ1 formed by the oblique direction D1 (the direction of the central axis 86) with the direction D2 perpendicular to the principal surfaces of the resin film 81 is, for example, 45° or less, and may be 30° or less. When the angle θ1 falls within these ranges, the flexibility in controlling the characteristics of an audio device by the use of the acoustic resistor 8 is further increased. The lower limit of the angle θ1 is not particularly defined, and the angle θ1 is, for example, 10° or more and may be 20° or more. If the angle θ1 is excessively large, the mechanical strength of the acoustic resistor 8 tends to decrease. The through holes 83 shown in FIG. 3 include a set of through holes for which the angles θ1 are different.

When the acoustic resistor 8 as shown in FIG. 3 which includes the resin film 81 in which the through holes 83 extending in different oblique directions coexist is viewed in a direction perpendicular to a principal surface of the resin film 81, namely when the oblique directions in which the through holes 83 extend are projected on the principal surface, the projected directions in which the through holes 83 extend may be parallel to each other. Alternatively, the resin film 81 may have a set of through holes 83 extending in the first projected direction and through holes 83 extending in the second projected direction, the first and second projected directions being different from each other (through holes 83 for which the projected directions are different from each other may coexist in the resin film 81). In the latter case, the resistance to gas flow in the passage 7 can be varied more widely, or in a different range, than in the case of an acoustic resistor 8 that does not have such a configuration, so that the flexibility in controlling the characteristics of an audio device by the use of the acoustic resistor 8 is further increased.

Figure 4:
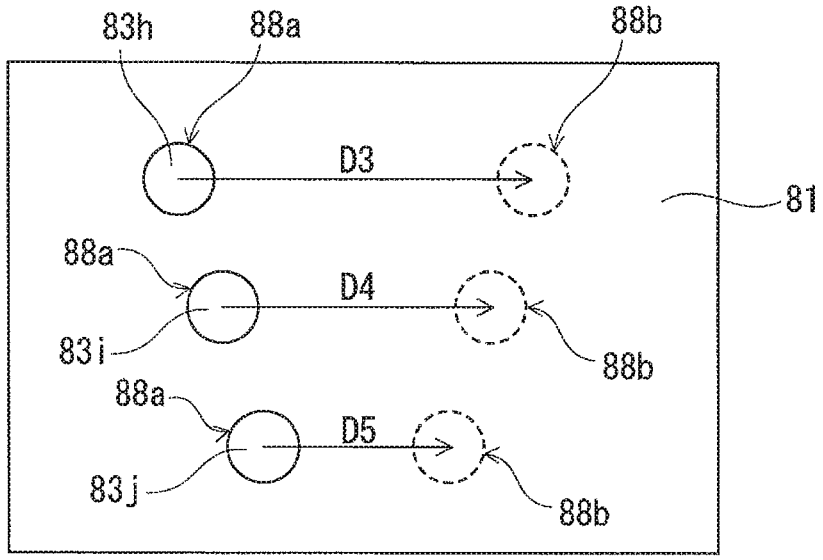
FIG. 4 is a plan view schematically showing an example of the relationship among through holes of the acoustic resistor of the present invention in terms of the directions in which the through holes extend.

FIG. 4 shows an example where the projected directions in which the through holes 83 extend when viewed in a direction perpendicular to a principal surface of the resin film 81 are parallel to each other. In the example shown in FIG. 4, there can be seen three through holes 83 (83*h*, 83*i*, and 83*j*). In the view taken in a direction perpendicular to a principal surface of the resin film 81, the directions D3, D4, and D5 in which the three through holes 83 respectively extend (the directions from openings 88*a* of the through holes 83 at the principal surface depicted on the sheet plane toward openings 88*b* of the through holes 83 at the opposite principal surface) are parallel to each other (this means that θ2 described later is 0°). It should be noted that the angles θ1 formed by the through holes 83*h*, 83*i*, and 83*j* are different from each other. The angle θ1 formed by the through hole 83*j* is smallest, and the angle θ1 formed by the through hole 83*h* is largest. Thus, the directions in which the through holes 83*h*, 83*i*, and 83*j* extend are different from each other in three dimensions.

Figure 5:
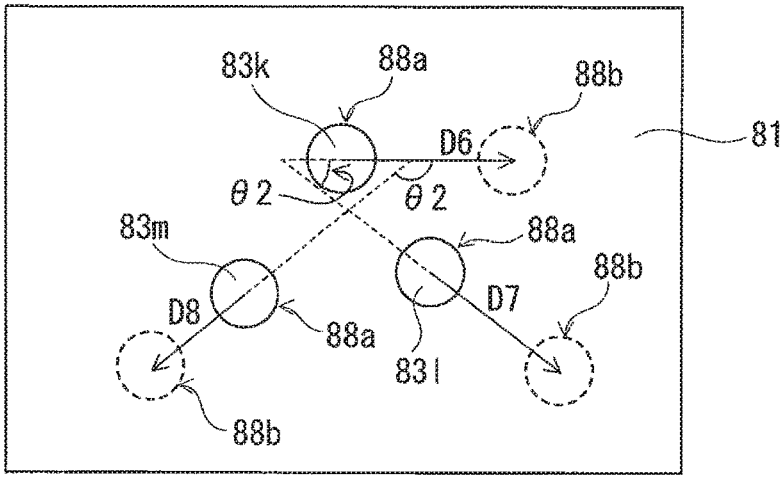
FIG. 5 is a plan view schematically showing another example of the relationship among through holes of the acoustic resistor of the present invention in terms of the directions in which the through holes extend.

FIG. 5 shows an example where the projected directions in which the through holes 83 extend when viewed in a direction perpendicular to a principal surface of the resin film 81 are different from each other. In the example shown in FIG. 5, there can be seen three through holes 83 (83*k*, 83*l*, and 83*m*). In the view taken in a direction perpendicular to a principal surface of the resin film 81, the directions D6, D7, and D8 in which the three through holes 83 respectively extend are different from each other. When viewed in a direction perpendicular to a principal surface of the resin film 81, the through holes 83*k* and 83*l* extend from the principal surface in different directions forming an angle θ2 of less than 90°. In contrast, the through holes 83*k* and 83*m* extend from the principal surface of the resin film 81 in different directions forming an angle θ2 of 90° or more when viewed in the direction perpendicular to the principal surface of the resin film 81. As in the latter case, the resin film 81 can have a set of through holes 83 that, when viewed in a direction perpendicular to a principal surface of the film, extend from the principal surface in different directions forming an angle θ2 of 90° or more. In other words, the resin film 81 as viewed in a direction perpendicular to a principal surface of the film can have a set of the through hole 83*k* extending from the principal surface in one direction D6 and the through hole 83*m* extending from the principal surface in another direction D8 forming an angle θ2 of 90° or more with the one direction D6. In this case, the flexibility in controlling the characteristics of an audio device by the use of the acoustic resistor 8 is further increased. The angle θ2 is, for example, 90° or more and 180° or less; namely, the angle θ2 may be 180°.

Figure 6:
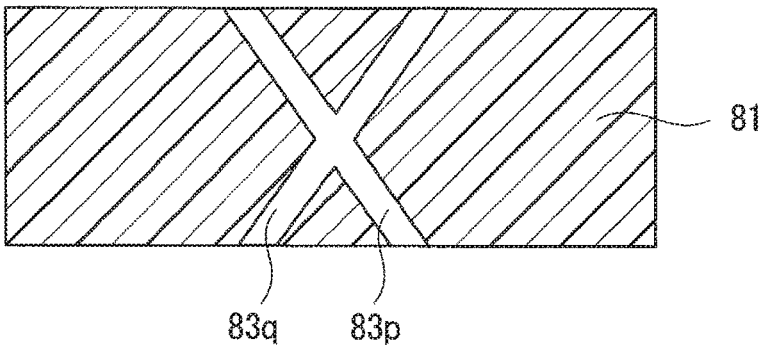
FIG. 6 is a cross-sectional view schematically showing still another example of the relationship among through holes of the acoustic resistor of the present invention in terms of the directions in which the through holes extend.

In the acoustic resistor 8 as shown in FIG. 4 which includes the resin film 81 in which the through holes 83 extending in different oblique directions coexist, two or more of the through holes 83 may cross each other at the inside of the resin film 81. That is, the resin film 81 may have a set of through holes 83 crossing each other at the inside of the film 81. In this case, the resistance to gas flow in the passage 7 can be varied more widely, or in a different range, than in the case of an acoustic resistor 8 that does not have such a configuration, so that the flexibility in controlling the characteristics of an audio device by the use of the acoustic resistor 8 is further increased. Such an example is shown in FIG. 6. In the example shown in FIG. 6, the through holes 83*p* and 83*q* cross each other at the inside of the resin film 81.

The directions in which the through holes 83 extend (the directions of the central axes 86 of the through holes 83) in the resin film 81 (or in the acoustic resistor 8) can be known, for example, by observing the principal surfaces and a cross-section of the film 81 with a scanning electron microscope (SEM).

The shape of the openings of the through holes 83 at the principal surfaces 84*a* and 84*b* of the resin film 81 is not limited, and is typically circular (when the direction of the central axis 86 is perpendicular to the principal surfaces 84*a* and 84*b* of the resin film 81) or elliptic (when the direction of the central axis 86 is oblique to the direction perpendicular to the principal surfaces 84*a* and 84*b* of the resin film 81). In this case, the shape of the openings of the through holes 83 need not be exactly circular or elliptic. For example, some degree of shape distortion caused by unevenness of etching performed in the production method described later is acceptable. The same applies to the shape of the cross-section of the through holes 83.

Figure 7:
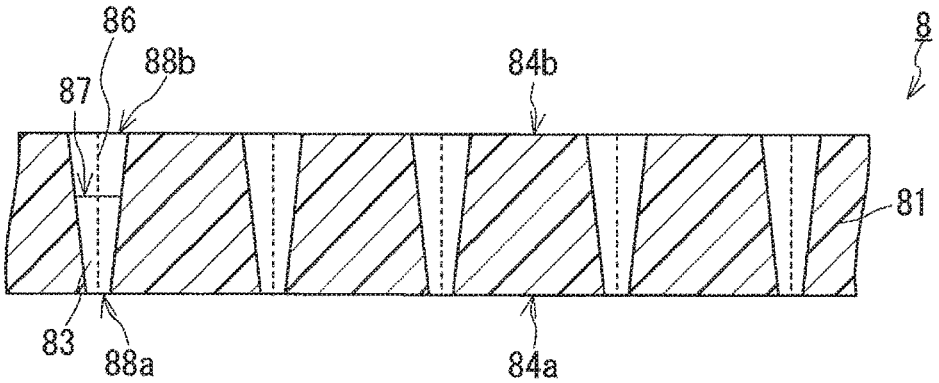
FIG. 7 is a cross-sectional view schematically showing still another example of the acoustic resistor of the present invention.

In the examples shown in FIGS. 2 to 6, the diameter of the through holes 83 hardly varies from the first principal surface 84*a* of the resin film 81 to the second principal surface 84*b*. This means that the shape of the cross-section of the through holes 83 remains almost unchanged from the principal surface 84*a* to the principal surface 84*b*. The through holes 83 of the acoustic resistor 8 may have a shape in which the area of a cross-section 87 perpendicular to the direction of the central axis 86 varies in the thickness direction of the resin film 81. In a specific example, the through holes 83 may have a shape in which the area of the cross-section 87 increases and/or decreases from the first principal surface 84*a* of the resin film 81 toward the second principal surface 84*b*. As shown in FIG. 7, the through holes 83 can have a shape in which the area of the cross-section 87 perpendicular to the direction of the central axis 86 increases from the first principal surface 84*a* of the resin film 81 toward the second principal surface 84*b*. In this case, the resistance to gas flow in the passage 7 can be varied more widely, or in a different range, than in the case of an acoustic resistor 8 that does not have such a configuration, so that the flexibility in controlling the characteristics of an audio device by the use of the acoustic resistor 8 is further increased. The through holes 83 shown in FIG. 7 are through holes having a shape that is asymmetrical in the thickness direction of the acoustic resistor 8 and resin film 81 and whose cross-section 87 varies in shape in the direction of the central axis 86.

When the through holes 83 have a shape in which the area of the cross-section 87 perpendicular to the direction of the central axis 86 increases from the first principal surface 84*a* of the resin film 81 toward the second principal surface 84*b*, the through holes 83 may have the cross-section 87 that is circular or elliptic and whose area increases continuously from the principal surface 84*a* toward the principal surface 84*b* at a constant or substantially constant rate. In this case, the shape of the through holes 83 corresponds to the entirety or a part of a circular or elliptic cone whose central line coincides with the axial line 86. The below-described production method which employs ion beam irradiation and etching is capable of forming the acoustic resistor 8 including the resin film 81 having the through holes 83 whose cross-section 87 is circular or elliptic.

When the through holes 83 have a shape in which the area of the cross-section 87 perpendicular to the direction of the central axis 86 increases from the first principal surface 84*a* of the resin film 81 toward the second principal surface 84*b*, the ratio a/b of the diameter (smaller diameter a) of the through holes 83 at the principal surface 84*a* to the diameter (larger diameter b) of the through holes at the principal surface 84*b* is, for example, 80% or less, and can be 75% or less or even 70% or less. The lower limit of the ratio a/b is not particularly defined and is, for example, 10%.

The area of the cross-section 87 may increase continuously from the principal surface 84*a* toward the principal surface 84*b* or may increase stepwise from the principal surface 84*a* toward the principal surface 84*b* (this means that the through holes 83 may have a region over which the area of the cross-section 87 is constant). It is preferable that the area of the cross-section 87 increase continuously from the principal surface 84*a* toward the principal surface 84*b* as in the example shown in FIG. 7, and it is more preferable that the increase rate be constant or substantially constant. The below-described production method which employs ion beam irradiation and etching is capable of forming; the acoustic resistor 8 including the resin film 81 having the through holes 83 having the cross-section 87 the area of which increases continuously from the principal surface 84*a* toward the principal surface 84*b*; and the acoustic resistor 8 in which the increase rate of the area is constant or substantially constant.

The above characteristics of the through holes 83 of the resin film 81 can be freely combined. For example, the through holes 83 may have a central axis 86 whose direction is oblique to a direction perpendicular to the principal surfaces 84*a* and 84*b* of the resin film 81 and have a shape in which the area of the cross-section 87 perpendicular to the direction of the central axis 86 increases from the first principal surface 84*a* of the resin film 81 toward the second principal surface 84*b*.

The diameter of the through holes 83 is, for example, 3.0 μm or more and 13.0 μm or less. When the diameter of the through holes 83 is in this range, the acoustic resistor 8 produces a particularly appropriate resistance to gas flow in the passage 7, so that the above-described effect obtained by the placement of the resistor 8 becomes particularly significant. When, as shown in FIG. 7, the through holes 83 have a shape in which the area of the cross-section 87 perpendicular to the direction of the central axis 86 increases from the first principal surface 84*a* of the resin film 81 toward the second principal surface 84*b*, the smaller diameter (the diameter of the through holes 83 at the principal surface 84*a* in the example shown in FIG. 7) can be 3.0 μm or more and 13.0 μm or less.

The diameter (opening diameter) of a through hole 83 can be determined as the diameter of a circle on the assumption that the opening of the through hole has the shape of the circle. Or, the diameter of a through hole 83 can be defined to correspond to the diameter of a circle having an area equal to the cross-sectional area (opening area) of the opening of the through hole. The diameters of the through holes 83 can be determined, for example, by observing the surfaces of the acoustic resistor 8 or resin film 81 with a microscope and analyzing the microscopic image. The diameters of the openings of the through holes 83 at each principal surface of the resin film 81 need not be exactly equal for all of the openings lying at the principal surface. However, it is preferable for the diameters in the effective portion of the resin film 81 (the portion that can be used in the acoustic resistor 8) to be so uniform that the diameters can be considered substantially equal (e.g., the standard deviation is 10% or less of the average). The below-described production method which employs ion beam irradiation and etching is capable of forming the resin film 81 and acoustic resistor 8 in which the through holes have such uniform diameters.

A through hole 83 extending obliquely to the direction perpendicular to the principal surfaces 84*a* and 84*b* of the resin film 81 can have an opening of elliptic shape. Also in such a case, the cross-section 87 of the through hole 83 inside the film 81 can be considered to be in the shape of a circle, and the diameter of this circle is equal to the minor axis of the ellipse corresponding to the shape of the opening. Thus, for the through hole 83 extending obliquely and having an opening of elliptic shape, the minor axis of the ellipse can be regarded as the opening diameter of the through hole.

The acoustic resistor 8 can have an air permeability of 0.01 (sec/100 $cm^3$) or more and 1.0 (sec/100 $cm^3$) or less as expressed in terms of Gurley number measured according to JIS L 1096 B in the thickness direction of the acoustic resistor 8. When the air permeability is in this range, the acoustic resistor 8 produces a particularly appropriate resistance to gas flow in the passage 7, so that the above-described effect obtained by the placement of the resistor 8 becomes particularly significant.

When, as shown in FIG. 7, the acoustic resistor 8 includes the resin film 81 having the through holes 83 having the cross-section 87 the area of which increases from the first principal surface 84*a* toward the second principal surface 84*b*, the air permeability of the resistor 8 in the direction from the second principal surface 84*b*, at which the diameter of the through holes 83 is larger, to the first principal surface 84*a*, at which the diameter of the through holes 83 is smaller, can be within the above range as expressed in terms of Gurley number.

The variation in air permeability of the acoustic resistor 8 is small. For example, when the air permeability of the acoustic resistor 8 is measured at randomly-selected 40 points on the resistor, the ratio σ/Av (air permeability variation index σ/Av) of the standard deviation σ of the measured values to the average Av of the measured values is 0.3 or less. The variation index can be 0.2 or less or even 0.1 or less.

The density of the through holes 83 (hole density) in the acoustic resistor 8 (or in the resin film 81) is not particularly limited and is, for example, $1\times10^3$ holes/cm$^2$ or more and $1\times10^9$ holes/cm$^2$ or less. When the hole density is in this range, the acoustic resistor 8 produces a particularly appropriate resistance to gas flow in the passage 7, so that the above-described effect obtained by the placement of the resistor 8 becomes particularly significant. The hole density need not be exactly constant over the entireties of the acoustic resistor 8 and resin film 81. However, the hole density in the effective portion is preferably so uniform that the maximum value of the hole density is equal to or less than 1.5 times the minimum value of the hole density. The hole density can be determined, for example, by observing the surfaces of the acoustic resistor 8 or resin film 81 with a microscope and analyzing the microscopic image.

The opening area ratio in the acoustic resistor 8 (or in the resin film 81) is, for example, 50% or less, and can be 10% or more and 45% or less, or 20% or more and 40% or less. The opening area ratio refers to the ratio of the sum of the areas of the openings of the through holes 83 at a principal surface of the resistor or resin film to the area of the principal surface. When the opening area ratio is in the above range, the acoustic resistor 8 produces a particularly appropriate resistance to gas flow in the passage 7, so that the above-described effect obtained by the placement of the resistor 8 becomes particularly significant. The opening area ratio can be determined, for example, by observing the surfaces of the acoustic resistor 8 or resin film 81 with a microscope and analyzing the microscopic image.

When, as shown in FIG. 7, the acoustic resistor 8 includes the resin film 81 having the through holes 83 having the cross-section 87 the area of which increases from the first principal surface 84*a* toward the second principal surface 84*b*, the opening area ratio can be in the above range for the principal surface 54*a* at which the diameter of the through holes is smaller.

The porosity of the acoustic resistor 8 (or of the resin film 81) is, for example, 25% or more and 45% or less, and can be 30% or more and 40% or less. When the porosity is in this range, the acoustic resistor 8 produces a particularly appropriate resistance to gas flow in the passage 7, so that the above-described effect obtained by the placement of the resistor 8 becomes particularly significant. When the resin film 81 has the through holes 83 having the cross-section 87 the area of which is constant in the resin film 81 as shown in FIG. 2, the opening area ratio corresponds to the porosity. When, as shown in FIG. 7, the resin film 81 has the through holes 83 having the cross-section 87 the area of which increases from the first principal surface 84*a* toward the second principal surface 84*b*, the porosity can be determined, for example, by calculation based on the opening area ratios in both of the principal surfaces 84*a* and 84*b* and on the shape of the through holes 83 which is confirmed by observing a cross-section of the resin film 81.

The apparent density of the acoustic resistor 8 (or of the resin film 81) is, for example, 0.7 g/cm$^3$ or more and 1.3 g/cm$^3$ or less, and can be 0.8 g/cm$^3$ or more and 1.2 g/cm$^3$ or less. When the apparent density is in this range, the acoustic resistor 8 produces a particularly appropriate resistance to gas flow in the passage 7, so that the above-described effect obtained by the placement of the resistor 8 becomes particularly significant. The apparent density can be determined by cutting the acoustic resistor into a piece of given size and dividing the weight W (g) of the piece of the resistor by its volume V (cm$^3$).

An audio device generally has a housing provided with a sound transmission port for transmission of sound between an acoustic element enclosed in the housing and the outside of the device, with the exception of devices such as a type of speaker whose acoustic element is exposed to the outside. In the earphone unit 1 shown in FIG. 1, the front housing 3*a* is provided with the sound transmission port 5. The acoustic resistor 8 can be placed in the gas passage that serves as a passage for transmission of sound between an acoustic element and the sound transmission port.

The fact that the acoustic resistor 8 including the resin film 81 having the configuration as described above can have high sound permeability is very advantageous when the acoustic resistor is placed between an acoustic element and a sound transmission port. For example, the insertion loss of the acoustic resistor 8 in the frequency range of 100 Hz to 5 kHz can be reduced to 5 dB or less, 3 dB or less, 2 dB or less, or even 1 dB or less, by adjusting the diameter of the through holes of the resin film 81 to 5.0 μm or more and 13.0 μm or less. The insertion loss of the resistor in the frequency range of 100 Hz to 3 kHz can be reduced to 5 dB or less, 3 dB or less, 2 dB or less, or even 1 dB or less. The frequencies ranging from 100 Hz to 5 kHz are those that humans use in their usual vocalization and conversation and correspond to those that humans can perceive most clearly when listening to played-back music etc. The small insertion loss in this frequency range enhances the market appeal of an audio device including the acoustic resistor 8. Additionally, for example, the insertion loss of the resistor at a frequency of 1 kHz, which is considered a median in the frequency range of human voice, can be reduced to 5 dB or less, 3 dB or less, 2 dB or less, or even 1 dB or less.

The thickness of the resin film 81 and the thickness of the acoustic resistor 8 are, for example, 5 μm or more and 100 μm or less and preferably 15 μm or more and 50 μm or less.

The material composing the resin film 81 is, for example, a material that allows the below-described production method to form the through holes 83 in an original film which is a non-porous resin film. The resin film 81 is composed of, for example, a resin degradable by an alkaline solution, an acidic solution, or an alkaline or acidic solution to which has been added at least one selected from an oxidant, an organic solvent, and a surfactant. In this case, the formation of the through holes 83 in the original film by ion beam irradiation and chemical etching becomes easier in the below-described production method. The solutions as mentioned above are typical etchants. From another standpoint, the resin film 81 is composed of, for example, a resin that can be etched by hydrolysis or oxidative degradation. The original film used can be a commercially-available film.

The resin film 81 is composed of, for example, at least one resin selected from polyethylene terephthalate (PET), polycarbonate, polyimide, polyethylene naphthalate, and polyvinylidene fluoride.

The acoustic resistor 8 may include two or more resin films 81. Such a acoustic resistor 8 can be formed, for example, by ion beam irradiation and chemical etching of a stack of two or more original films.

The acoustic resistor 8 may, if desired, include any member and/or layer other than the resin film 81.

Figure 8:
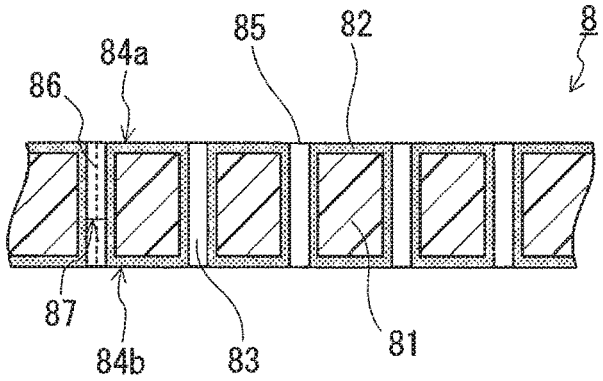
FIG. 8 is a cross-sectional view schematically showing a different example of the acoustic resistor of the present invention.

The acoustic resistor 8 can further include, for example, a liquid-repellent layer 82. The acoustic resistor 8 further including the liquid-repellent layer 82 can have waterproofness. The liquid-repellent layer 82 can be formed, for example, by liquid-repellent treatment of the resin film 81. In the example shown in FIG. 8, the liquid-repellent layer 82 is formed on both of the principal surfaces 84*a* and 84*b* of the resin film 81 and on the surfaces of the through holes 83. The acoustic resistor 8 shown in FIG. 8 has the same configuration as the acoustic resistor 8 shown in FIG. 2, except that the liquid-repellent layer 82 is formed.

The liquid-repellent layer 82 may be formed only on one of the principal surfaces of the resin film 81 or may be formed only on one of the principal surfaces and on the surfaces of the through holes 83. The liquid-repellent layer 82 is preferably formed at least on the principal surface that can contact water when the resistor is disposed in an audio device.

The liquid-repellent layer 82 is a water-repellent layer and preferably further has oil repellency. The liquid-repellent layer 82 has openings 85 positioned in correspondence with the through holes 83 of the resin film 81.

The liquid-repellent layer 82 can be formed, for example, as follows: A treatment liquid prepared by diluting a water-repellent agent or hydrophobic oil-repellent agent with a diluent is thinly spread and dried on the resin film 81. Examples of the water-repellent agent and hydrophobic oil-repellent agent include fluorine compounds such as perfluoroalkyl acrylate and perfluoroalkyl methacrylate. The thickness of the liquid-repellent layer 82 is preferably less than ½ of the diameter of the through holes 83.

When the liquid-repellent layer 82 is formed by thinly spreading a treatment liquid on the resin film 81, the surfaces (inner peripheral surfaces) of the through holes 83 can, depending on their diameter, be coated with the liquid-repellent layer 82 extending continuously from the principal surfaces of the resin film 81.

The waterproofness imparted to the acoustic resistor 8 by the liquid-repellent layer 82 can be evaluated, for example, by a water entry pressure measured according to Method B (high hydraulic pressure method) of water penetration test specified in JIS L 1092. The water entry pressure is, for example, 2 kPa or more.

Figure 9:
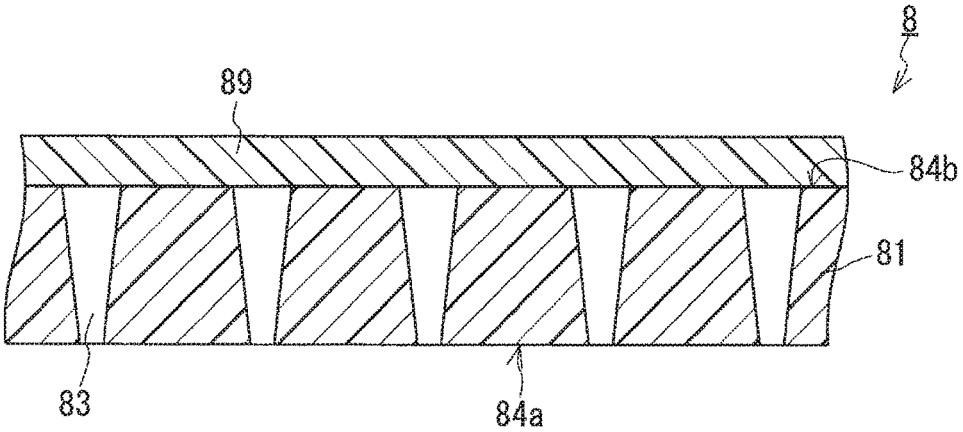
FIG. 9 is a cross-sectional view schematically showing a different example of the acoustic resistor of the present invention.

The acoustic resistor 8 can further include, for example, an air-permeable supporting layer 89. In the acoustic resistor 8 shown in FIG. 9, the air-permeable supporting layer 89 is placed on the principal surface 84*b* of the resin film 81 of the acoustic resistor 8 as shown in FIG. 7. The placement of the air-permeable supporting layer 89 improves the strength and handling properties of the acoustic resistor 8. The air-permeable supporting layer 89 may be placed on one of the principal surfaces of the resin film 81 or on both of the principal surfaces.

The air-permeable supporting layer 89 has a higher air permeability in the thickness direction than the resin film 81. The air-permeable supporting layer 89 used can be, for example, a woven fabric, non-woven fabric, net, or mesh. Examples of the material composing the air-permeable supporting layer 89 include polyester, polyethylene, and aramid resin. The shape of the air-permeable supporting layer 89 may be the same as or different from the shape of the resin film 81. For example, the air-permeable supporting layer 89 can have a shape adapted for placement only on the peripheral portion of the resin film 81 (in particular, a ring shape adapted for placement only on the peripheral portion of the resin film that is circular). The air-permeable supporting layer 89 is placed, for example, by a technique such as thermal welding, or bonding by an adhesive, to the resin film 81.

The surface density of the acoustic resistor 8 is preferably 5 to 100 g/m$^2$ and more preferably 10 to 50 g/m$^2$, in terms of the strength, production yield, handling properties including attachment accuracy, and sound permeability of the membrane.

The acoustic resistor 8 may be subjected to a coloring treatment. Depending on the type of the material composing the resin film 81, the acoustic resistor 8 not subjected to any coloring treatment is, for example, transparent or white. Such an acoustic resistor 8 may be conspicuous when the resistor 8 is placed in the vicinity of the opening 6 of the housing 3. Such a conspicuous membrane may so stimulate the curiosity of a user as to induce the user to stab the acoustic resistor with a needle or the like, thereby impairing the function of the acoustic resistor. When the acoustic resistor 8 has been subjected to a coloring treatment so that, for example, the acoustic resistor 8 has a color identical or similar to the color of the housing, the potential to attract the user's attention can be relatively reduced. In some cases, a colored acoustic resistor is required in view of the design and visual appearance of an audio device. Such a requirement can be met by means of the coloring treatment.

The coloring treatment can be accomplished, for example, by dyeing the resin film 81 or by incorporating a colorant into the resin film 81. The coloring treatment may be carried out, for example, so as to enable absorption of light in the wavelength range of 380 nm to 500 nm. That is, the acoustic resistor 8 may be subjected to a coloring treatment that enables the resistor 8 to absorb light in the wavelength range of 380 nm to 500 nm. To this end, for example, the resin film 81 contains a colorant having the ability to absorb light in the wavelength range of 380 nm to 500 nm or is dyed with a dye having the ability to absorb light in the wavelength range of 380 nm to 500 nm. In this case, the acoustic resistor 8 can be colored, for example, blue, gray, brown, pink, green, or yellow. The acoustic resistor 8 may be colored black, gray, brown, or pink.

When the acoustic resistor 8 is colored black or gray, the degree of coloring is preferably such that the whiteness W described below is in the range of 15.0 to 40.0. The whiteness W can be determined as follows: The lightness L, hue a, and chroma b of a principal surface of the acoustic resistor 8 are measured using a color-difference meter according to JIS L 1015 (Hunter method), and the whiteness W is calculated from the measured values using the following equation: $W=100-\mathrm{sqr}[(100-L)^2+(a^2+b^2)]$. The lower the value of the whiteness W is, the blacker the acoustic resistor 8 is.

[Method for Producing Acoustic Resistor]

The method for producing the acoustic resistor 8 is not particularly limited. For example, the acoustic resistor 8 can be produced by the production method described below.

In the production method which will be described hereinafter, a resin film 81 is formed by ion beam irradiation and the subsequent etching (chemical etching) of an original film. The resin film 81 as formed by ion beam irradiation and etching can be used as an acoustic resistor 8 without any processing. If desired, the resin film 81 can be processed into an acoustic resistor 8 through an additional step such as a step of forming a liquid-repellent layer 82, a coloring treatment step, or a step of stacking an air-permeable supporting layer 89.

With the method which employs ion beam irradiation and the subsequent etching, it is easy, for example, to control various factors such as the diameters of the through holes 83 of the resin film 81, the uniformity of the diameters, the directions of the central axes 86, the hole density, the opening area ratio, and the porosity. This increases the flexibility in controlling the resistance to gas flow in the passage 7 by the placement of the acoustic resistor 8.

The original film is a non-porous resin film having no passage that allows through-thickness air permeation in its portion that is to be used as the acoustic resistor 8 after ion beam irradiation and etching. The original film may be an imperforate film. The fact that the original film is a non-porous resin film means that when the original film is irradiated with an ion beam and then chemically etched to form the through holes 83 and thus obtain the resin film 81, the variation in properties of the film 81 can be made smaller than, for example, that of a woven structure such as a mesh or of a non-woven fabric structure.

When the original film is irradiated with an ion beam, the polymer chains constituting the resin film are bombarded with and damaged by ions in those portions of the film through which the ions pass. The damaged polymer chains are more susceptible to chemical etching than the other polymer chains not bombarded with the ions. Chemical etching of the ion beam-irradiated original film thus results in a resin film having minute holes (through holes) extending along the tracks of the bombarding ions. That is, the directions of the central axes 86 of the through holes 83 coincide with the directions in which the ions have passed through the original film during the ion beam irradiation. In general, no minute holes are formed in those portions of the original film through which no ions have passed.

This method for forming the resin film 81 from an original film may include the steps of: (I) irradiating a non-porous original film with an ion beam; and (II) chemically etching the ion beam-irradiated original film. In the step (I), the tracks of bombarding ions (ion tracks) are formed in the original film so as to extend straight through the thickness of the film. In the step (II), the through holes 83 corresponding to the ion tracks formed in the step (I) are formed in the original film by chemical etching to obtain the resin film 81 having air permeability in the thickness direction thereof.

This method is capable of forming the resin film 81 as shown in FIG. 2 which has the through holes 83 having the cross-section 87 (cross-section perpendicular to the direction of the central axis 86) the area of which is constant or substantially constant from the first principal surface 84*a* toward the second principal surface 84*b*, and is also capable of forming the resin film 81 having the through holes 83 in which the cross-sectional area increases from the first principal surface 84*a* toward the second principal surface 84*b*. The resin film 81 of the former kind can be formed, for example, by chemically etching the ion-irradiated original film directly. The etching removes the portions corresponding to the ion tracks formed in the original film. Thus, the through holes 83 whose cross-section 87 has a constant or substantially constant area are formed by allowing the chemical etching to proceed over a sufficiently long time.

The resin film 81 of the latter kind can be formed, for example, by carrying out the chemical etching in the step (II) in such a manner that the extent of the etching of the ion-bombarded portions from one principal surface is greater than the extent of the etching of the ion-bombarded portions from the other principal surface. Specifically, for example, the resin film can be formed by performing the chemical etching with a masking layer placed on one principal surface of the ion-irradiated original film. In this chemical etching, the extent of the etching from the other principal surface is greater than the extent of the etching from the one principal surface with the masking layer placed thereon. Such non-uniform etching, in particular etching in which the rate of etching from one principal surface of the ion-irradiated original film and the rate of etching from the other principal surface are different, is capable of forming the through holes 83 having a shape in which the area of the cross-section 87 perpendicular to the direction of the central axis 86 changes from one principal surface of the resin film 81 toward the other principal surface of the resin film 81. In the etching process for forming the resin film 81 of the former kind without the use of a masking layer, the etching of the ion beam-irradiated original film progresses uniformly from both principal surfaces of the original film.

Hereinafter, the steps (I) and (II) will be described in more detail.

[Step (I)]

In the step (I), an original film is irradiated with an ion beam. The ion beam is composed of accelerated ions. The irradiation with an ion beam causes the original film to be bombarded with the ions in the beam.

Figure 10:
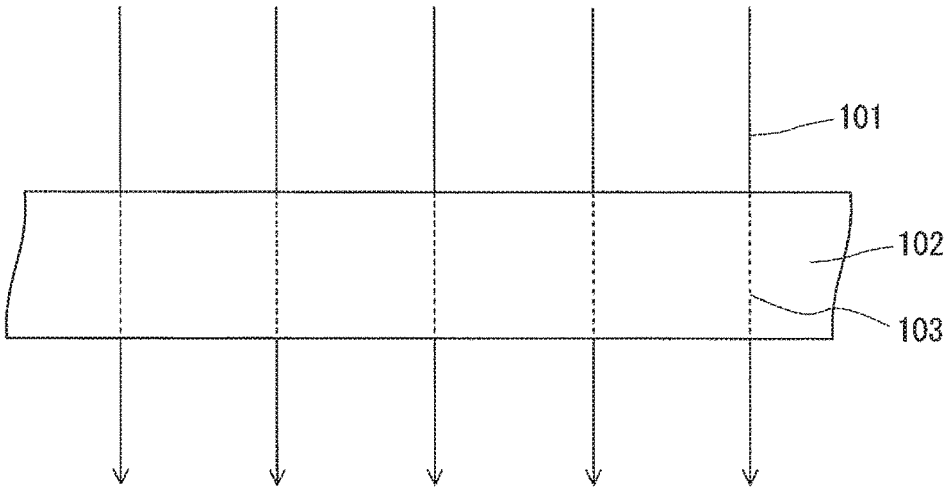
FIG. 10 is a schematic diagram for illustrating the overview of ion beam irradiation in a method for forming a resin film of the acoustic resistor of the present invention by employing the ion beam irradiation and the subsequent chemical etching.

FIG. 10 illustrates irradiation of an original film with an ion beam. Ions 101 in the beam collide with an original film 102, and the ions 101 having collided with the film 102 leave tracks (ion tracks) 103 within the film 102. When viewed on the size scale of the original film 102 to be irradiated, the ions 101 bombard the original film 102 typically along a substantially straight line, thus forming the tracks 103 extending substantially straight in the film 102. In general, the ions 101 penetrate through the original film 102.

The method for irradiating the original film 102 with the ion beam is not limited. For example, the original film 102 is placed in a chamber, the internal pressure of the chamber is reduced (for example, a high vacuum atmosphere is created in the chamber to prevent energy attenuation of the bombarding ions 101), and then the ions 101 are emitted from a beamline to irradiate the original film 102. A particular gas may be introduced into the chamber. Alternatively, ion beam irradiation of the original film 102 placed in the chamber may be carried out without reduction in the internal pressure of the chamber; for example, the ion beam irradiation may be carried out at atmospheric pressure.

It is also conceivable to prepare a roll on which the original film 102 in the form of a long sheet is wound and continuously irradiate the original film 102 with the ion beam while feeding the original film 102 from the roll. This allows efficient formation of the resin film 81. It is also conceivable to dispose the roll (feed roll) and a take-up roll for winding up the ion beam-irradiated original film 102 in the chamber described above, create an appropriate atmosphere such as a reduced-pressure or high vacuum atmosphere in the chamber, then continuously irradiate the original film 102 in the form of a long sheet with the ion beam while feeding the film from the feed roll, and then wind the beam-irradiated original film 102 on the take-up roll.

The resin composing the original film 102 is identical to the resin composing the resin film 81 and is, for example, at least one selected from PET, polycarbonate, polyimide, polyethylene naphthalate, and polyvinylidene fluoride. The original film 102 composed of at least one of these resins is characterized in that chemical etching progresses smoothly in those portions of the film which have been bombarded with the ions 101, while chemical etching progresses slowly in the rest of the film. This allows easier control of chemical etching of those portions of the original film 102 which correspond to the tracks 103. Thus, for example, the use of such an original film 102 makes easier the control of the shape of the through holes 83 of the resin film 81.

The thickness of the original film 102 is, for example, 5 to 100 μm. In general, the thickness of the original film 102 remains unchanged before and after the ion beam irradiation in the step (I).

The original film 102 to be irradiated with the ion beam is, for example, an imperforate film. In this case, the resin film 81 having no holes other than the through holes 83 formed by the steps (I) and (II) can be obtained unless an additional step of forming holes in the film is performed in addition to the steps (I) and (II). When the additional step is performed, the resulting resin film 81 has the through holes 83 formed by the steps (I) and (II) and holes formed by the additional step.

The type of the ions 101 with which the original film 102 is irradiated and bombarded is not limited. It is preferable for the ions to include ions having a larger mass number than neon, specifically at least one species selected from argon ions, krypton ions, and xenon ions, since these ions do not readily chemically react with the resin composing the original film 102.

The energy (acceleration energy) of the ions 101 is typically 100 to 1000 MeV. When the original film 102 used is a polyester film having a thickness of about 5 to 100 μm and the ions 101 are argon ions, the energy of the ions 101 is preferably 100 to 600 MeV. The energy of the ions 101 to be applied to the original film 102 can be adjusted depending on the type of the ions and on the type of the resin composing the original film 102.

The ion source of the ions 101 to be applied to the original film 102 is not limited. For example, the ions 101 emitted from the ion source are accelerated by an ion accelerator, then passed through a beamline, and applied to the original film 102. The ion accelerator is, for example, a cyclotron, a specific example of which is an AVF cyclotron.

The pressure in the beamline serving as a path of the ions 101 is preferably a high vacuum pressure of about $10^{-5}$ to $10^{-3}$ Pa, in terms of preventing the energy attenuation of the ions 101 in the beamline. When the pressure in the chamber enclosing the original film 102 to be irradiated with the ions 101 does not reach a high vacuum pressure, a partition permeable to the ions 101 may be used to maintain the pressure difference between the beamline and the chamber. The partition is made up of, for example, a titanium membrane or aluminum membrane.

The ions 101 are applied to the original film 102, for example, in a direction perpendicular to the principal surfaces of the film. The irradiation in the example shown in FIG. 10 is performed in this manner. In this case, the tracks 103 extend perpendicular to the principal surfaces of the original film 102; thus, the subsequent chemical etching results in the resin film 81 having through holes 83 formed to have a central axis 86 extending in the direction perpendicular to the principal surfaces of the resin film 81. The ions 101 may be applied to the original film 102 in a direction oblique to the principal surfaces of the film. In this case, the subsequent chemical etching results in the resin film 81 having through holes 83 formed to have a central axis 86 extending in a direction oblique to the direction perpendicular to the principal surfaces of the resin film 81. The direction of the ions 101 applied to the original film 102 can be controlled by known means. The angle θ1 shown in FIG. 3 can be controlled, for example, by adjusting the incident angle of the ion beam to the original film 102.

The ions 101 are applied to the original film 102, for example, in such a manner that the trajectories of the ions 101 are parallel to each other. The irradiation in the example shown in FIG. 10 is performed in this manner. In this case, the subsequent chemical etching results in the resin film 81 having through holes 83 formed to extend parallel to each other.

The ions 101 may be applied to the original film 102 in such a manner that the trajectories of the ions 101 are non-parallel to each other (random with respect to each other, for example). This results in, for example, the resin film 81 as shown in any of FIGS. 3 to 6. Specifically, for example, a possible method for forming the resin film 81 as shown in any of FIGS. 3 to 6 is to apply the ion beam to the original film 102 in a direction oblique to the direction perpendicular to the principal surfaces of the original film 102 while changing the oblique direction continuously or stepwise. Since the ion beam is composed of ions traveling parallel to each other, the resin film 81 typically has a set of through holes 83 extending in the same direction (there are typically two or more through holes 83 extending in the same direction in the resin film 81).

Figure 11:
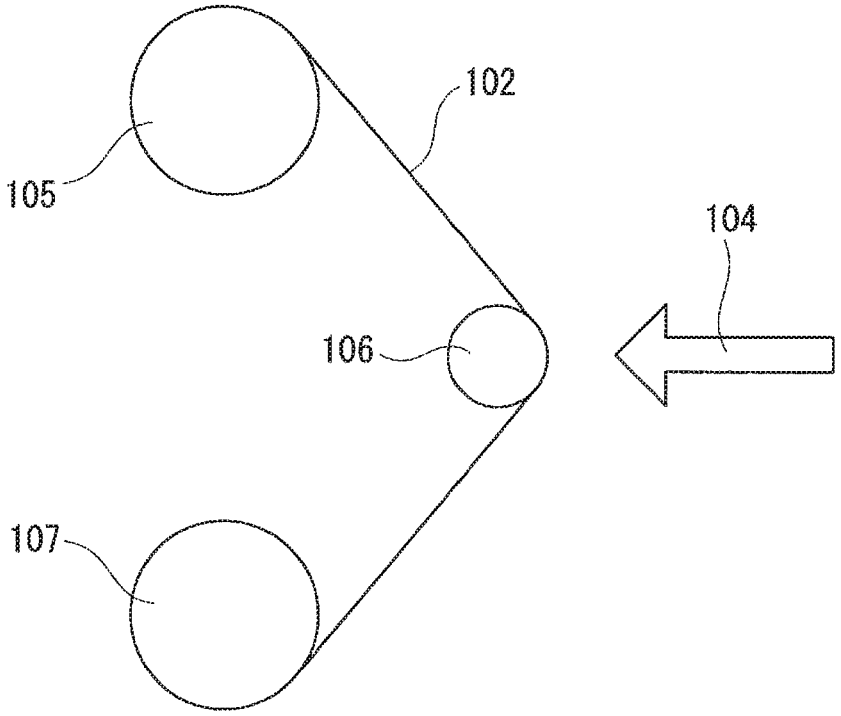
FIG. 11 is a schematic diagram for illustrating an example of ion beam irradiation in a method for forming a resin film of the acoustic resistor of the present invention by employing the ion beam irradiation and the subsequent chemical etching.

FIG. 11 shows an example of the method in which the oblique direction is changed continuously or stepwise. In the example shown in FIG. 11, the original film 102 in the form of a long sheet is fed from a feed roll 105, passed through an irradiation roll 106 with a predetermined curvature, and irradiated with an ion beam 104 while moving on the roll 106, after which the irradiated original film 102 is wound on a take-up roll 107. During this process, the ions 101 in the ion beam 104 travel parallel to each other and reach the original film 102 successively. Thus, the angle (incident angle θ1) at which the ion beam impinges on the principal surface of the original film 102 varies with the movement of the original film 102 on the irradiation roll 106. Continuous emission of the ion beam 104 allows continuous change of the oblique direction, while intermittent emission of the ion beam 104 allows stepwise change of the oblique direction. Such control can be considered to be based on ion beam emission timing. The properties (for example, angle θ1) of the tracks 103 to be formed in the original film 102 can be controlled also by adjusting the cross-sectional shape of the ion beam 104 and the cross-sectional area of the beamline of the ion beam 104 formed on the irradiation target surface of the original film 102.

The hole density of the resin film 81 can be controlled by the conditions of the irradiation of the original film 102 with the ion beam (such as the type of the ions, the energy of the ions, and the density of the bombarding ions (irradiation density)).

The ions 101 may be emitted from two or more beamlines to irradiate the original film 102.

The step (I) may be performed in the presence of a masking layer on a principal surface, such as the one principal surface as described above, of the original film 102. In this case, for example, the masking layer can be used also in the step (II).

[Step (II)]

The original film 102 irradiated with the ion beam in the step (I) has portions bombarded with the ions 101 and, in the step (II), at least part of the ion-bombarded portions are chemically etched to form through holes 83 extending along the tracks 103 of the bombarding ions 101 in the film. The resin film 81 thus obtained is basically identical to the original film 102 that has yet to be subjected to the ion beam irradiation except for the presence of the through holes 83, unless another step of modifying the nature of the film is performed.

The specific technique employed for the etching may be the same as any of known techniques. For example, the ion beam-irradiated original film 102 may be immersed in an etchant at a predetermined temperature for a predetermined time. Adjusting the etching conditions such as the etching temperature, the etching time, and the composition of the etchant allows, for example, control of the diameter of the through holes 83.

The etching temperature is, for example, 40 to 150° C., and the etching time is, for example, 10 seconds to 60 minutes.

The etchant used in the chemical etching is not particularly limited. The etchant is, for example, an alkaline solution, an acidic solution, or an alkaline or acidic solution to which has been added at least one selected from an oxidant, an organic solvent, and a surfactant. The alkaline solution is, for example, a solution (typically an aqueous solution) containing a base such as sodium hydroxide or potassium hydroxide. The acidic solution is, for example, a solution (typically an aqueous solution) containing an acid such as nitric acid or sulfuric acid. The oxidant is, for example, potassium dichromate, potassium permanganate, or sodium hypochlorite. The organic solvent is, for example, methanol, ethanol, 2-propanol, ethylene glycol, amino alcohol, N-methylpyrrolidone, or N,N-dimethylformamide. The surfactant is, for example, an alkyl benzenesulfonic acid salt or an alkyl sulfuric acid salt.

In the step (II), the chemical etching is performed in the presence of a masking layer on one principal surface of the ion beam-irradiated original film 102. In this chemical etching of those portions of the original film 102 which have been bombarded with the ions 101, the extent of etching from the other principal surface is greater than the extent of etching from the one principal surface with the masking layer thereon. That is, the chemical etching of those portions of the original film 102 which have been bombarded with the ions 101 is performed in such a manner that the etching from one principal surface of the film and the etching from the other principal surface of the film progress in a non-uniform fashion (such etching may be referred to as "non-uniform etching"). Saying that "the extent of etching is great" specifically means, for example, that the amount of etching of the ion-bombarded portions per unit time is large, namely, that the rate of etching of the portions is high.

In the step (II), a masking layer more resistant to chemical etching than those portions of the original film 102 which have been bombarded with the ions 101 may be placed on one principal surface of the original film 102 to perform chemical etching in which the etching of the portions from the other principal surface of the original film 102 is allowed to progress while the etching of the portions from the one principal surface is inhibited. Such etching can be accomplished, for example, by appropriately selecting the type and thickness of the masking layer, the manner of the placement of the masking layer, and the etching conditions.

The type of the masking layer is not particularly limited. The masking layer is preferably composed of a material more resistant to chemical etching than those portions of the original film 102 which have been bombarded with the ions 101. Saying that a material is "resistant to etching" specifically means, for example, that the amount of the material etched per unit time is small, namely, that the rate at which the material is etched is low. Whether a material is resistant to chemical etching can be determined on the basis of the conditions (such as the type of the etchant, the etching temperature, and the etching time) of the non-uniform etching to be actually performed in the step (II). When, in the step (II), non-uniform etching is performed a plurality of times by changing the type of the masking layer and/or alternating the surface on which the layer is placed, whether a material is resistant to chemical etching can be determined for each etching on the basis of the etching conditions.

The masking layer may be more susceptible or more resistant to chemical etching than those portions of the original film 102 which have not been bombarded with the ions 101. The masking layer is preferably more resistant to chemical etching than such portions. In this case, for example, the thickness required of the masking layer used in the non-uniform etching can be decreased.

When the original film 102 with a masking layer thereon is irradiated with the ion beam in the step (I), ion tracks are formed also in the masking layer. Given this, the material composing the masking layer is preferably a material having polymer chains more resistant to damage by ion beam irradiation.

The masking layer is composed of, for example, at least one selected from polyolefin, polystyrene, polyvinyl chloride, polyvinyl alcohol, and a metal foil. These materials are resistant to chemical etching as well as being more resistant to damage by ion beam irradiation.

When a masking layer is used to perform non-uniform etching, the masking layer can be placed on at least a portion of one principal surface of the original film 102, the portion corresponding to the area to be subjected to the non-uniform etching. The masking layer can, if desired, be placed over the entirety of one principal surface of the original film 102.

The method for placing the masking layer on a principal surface of the original film 102 is not limited as long as the masking layer is not separated from the principal surface during the non-uniform etching. The masking layer is placed on the principal surface of the original film 102, for example, by means of an adhesive. That is, in the step (II), the chemical etching (non-uniform etching) may be performed in the presence of a masking layer bonded to the one principal surface of the original film 102 by means of an adhesive. It is relatively easy to dispose the masking layer by means of an adhesive. Appropriately selecting the type of the adhesive makes it easy to separate the masking layer from the original film 102 after the non-uniform etching.

When the non-uniform etching is performed in the step (II), the non-uniform etching may be performed a plurality of times. Uniform etching in which etching of the tracks 103 is allowed to progress uniformly from both principal surfaces of the original film 102 may be performed in combination with the non-uniform etching. For example, the masking layer may be separated from the original film 102 in the course of the etching to switch the mode of etching from the non-uniform etching to the uniform etching. Alternatively, the masking layer may be placed on the original film 102 after the end of the uniform etching to subsequently perform the non-uniform etching.

When the non-uniform etching employing a masking layer is performed in the step (II), a part or the whole of the masking layer may, if desired, be allowed to remain on the resin film 81 after the etching. The masking layer remaining on the resin film 81 can be used, for example, as an indicator for differentiating between the one principal surface (the principal surface with the masking layer thereon) of the resin film 81 and the other principal surface of the resin film 81.

When etching is performed a plurality of times in the step (II), the etching conditions may be changed for each time of etching.

The method for producing the resin film 81 may include any step other than the steps (I) and (II).

[Acoustic Resistor Member]

Figure 12:
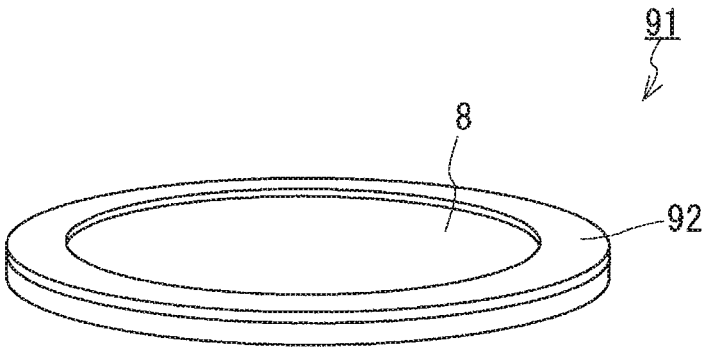
FIG. 12 is a perspective view schematically showing an example of the acoustic resistor member of the present invention.

An example of the acoustic resistor member of the present invention is shown in FIG. 12. An acoustic resistor member 91 shown in FIG. 12 includes: an acoustic resistor 8 that is circular when viewed in a direction perpendicular to the principal surfaces of the acoustic resistor 8; and a supporting member 92 that is a ring-shaped sheet joined to a peripheral portion of the resistor 8. Joining the supporting member 92 to the acoustic resistor 8 reinforces the acoustic resistor 8 and improves its handling properties. Additionally, when the acoustic resistor member 91 is placed in an audio device, the supporting member 92 can serve as a portion for attachment which makes easier the attachment of the acoustic resistor 8.

Figure 13:
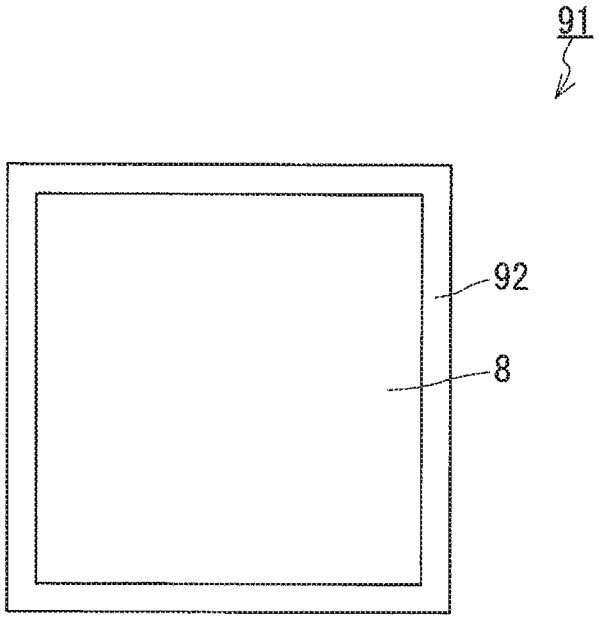
FIG. 13 is a plan view schematically showing another example of the acoustic resistor member of the present invention.

The shape of the supporting member 92 is not limited. For example, as shown in FIG. 13, the supporting member 92 may be a frame-shaped sheet joined to the peripheral portion of the acoustic resistor 8 that is rectangular when viewed in a direction perpendicular to the principal surfaces of the acoustic resistor 8. Conforming the shape of the supporting member 92 to the shape of the peripheral portion of the acoustic resistor 8 as shown in FIGS. 12 and 13 reduces the deterioration in the characteristics of the acoustic resistor 8 caused by the placement of the supporting member 92. It is preferable for the supporting member 92 to be in the form of a sheet, in terms of the handling properties of the acoustic resistor 8 and the ease of placement of the acoustic resistor 8 in an audio device.

Examples of the material composing the supporting member 92 include resins, metals, and composites thereof. Examples of the resins include: polyolefins such as polyethylene and polypropylene; polyesters such as PET and polycarbonate; polyimides; and composites of these resins. Examples of the metals include metals having high corrosion resistance such as stainless steel and aluminum.

The thickness of the supporting member 92 is, for example, 5 to 500 μm and preferably 25 to 200 μm. In particular, in view of its function as the portion for attachment, the ring width (frame width: the difference between the outer size and inner size) is suitably about 0.5 to 2 mm. A foamed material made of any of the resins mentioned above may be used as the supporting member 92.

The method for joining the acoustic resistor 8 and the supporting member 92 together is not particularly limited. Examples of methods that can be employed include thermal welding, ultrasonic welding, bonding by an adhesive, and bonding by a double-sided tape.

The acoustic resistor member 91 may include two or more acoustic resistors 8 and/or two or more supporting members 92.

[Audio Device]

An example of the audio device of the present invention is the earphone unit 1 shown in FIG. 1. The details of the configuration of the earphone unit 1 are as described above in the explanation of the acoustic resistor.

As shown in FIG. 1, the audio device of the present invention has a passage 7 which communicates with an opening formed in the housing of the device and in which an acoustic element is disposed, and the acoustic resistor 8 is placed between the opening and the acoustic element in the passage 7. Being "placed between the opening and the acoustic element" includes the situation where the acoustic resistor 8 is attached to the opening or, in particular, joined to the housing so as to cover the opening. In this case, the acoustic resistor 8 may be joined to the inner wall or outer wall of the housing.

The opening with which the passage 7 communicates may be a sound transmission port or an opening other than the sound transmission port. In the earphone unit 1 shown in FIG. 1, the passage 7 in which the acoustic resistor 8 is placed communicates with the opening 6 which is different from the sound transmission ports 5. For example, the housing of the audio device of the present invention may be provided with two or more openings including a sound transmission port for transmission of sound between the acoustic element and the outside of the housing, and the acoustic resistor 8 may be placed at least in a passage 7 that communicates with the opening other than the sound transmission port. The acoustic resistors 8 may be placed both in a passage 7 communicating with the sound transmission port and in another passage 7 communicating with an opening other than the sound transmission port. Two or more acoustic resistors 8 may be placed in the audio device, and the number of the acoustic resistors 8 placed in one passage 7 may be two or more.

The passage 7 extending from the acoustic element may communicate with two or more openings and, in this case, at least one of the two or more openings may be a sound transmission port. In other words, the passage 7 extending from the acoustic element may communicate with the sound transmission port and an opening other than the sound transmission port.

The design of the passage 7, the location and number of the acoustic resistors 8 to be placed in the passage 7, and the characteristics (such as the through hole diameter and air permeability) of the acoustic resistors 8 can be freely adjusted depending on the desired audio device characteristics.

The acoustic resistor 8 is, for example, placed to cover a cross-section of the passage 7. The acoustic resistor 8 may be placed to cover a part of the cross-section of the passage 7.

When the acoustic resistor 8 has dustproofness, an audio device having dustproofness can be obtained depending on how the acoustic resistor 8 is placed. For example, the acoustic resistor 8 is placed to cover an opening communicating with the passage 7 to achieve the dustproofness. When the acoustic resistor 8 has waterproofness, an audio device having waterproofness can be obtained depending on how the acoustic resistor 8 is placed. For example, the acoustic resistor 8 is placed to cover an opening communicating with the passage 7 to achieve the waterproofness.

The way of placing the acoustic resistor 8 in the passage 7 is not limited. In the earphone unit 1 shown in FIG. 1, the acoustic resistor 8 is joined to the frame 23, which is provided with the opening 24 constituting a part of the passage 7, in such a manner as to cover the opening 24. When the acoustic resistor 8 is placed in the passage 7 by joining the resistor 8 to a component of the audio device, the joining can be done using a technique such as bonding by a double-sided tape, thermal welding, high-frequency welding, or ultrasonic welding. With the use of bonding by a double-sided tape, the double-sided tape can be utilized as the supporting member 92, and the joining of the acoustic resistor 8 can be accomplished more reliably and accurately.

The shape of the acoustic resistor 8 is not limited. The shape of the acoustic resistor 8 is, for example, a disc shape, a circular cylindrical shape, a ring shape, or a part of any of these shapes (e.g., a shape corresponding to a part of a ring, such as a crescent or semilunar shape). The shape of the acoustic resistor 8 can be freely adjusted according to the shape of the passage 7 in which the acoustic resistor 8 is to be placed or the shape of the cross-section of the passage 7.

The acoustic element has the function of sending and/or receiving sound. The acoustic element is, for example, a vibration plate (a vibrating film, vibrating membrane, or diaphragm).

The location of the acoustic element placed in the passage 7 is not limited. For example, the acoustic element may be placed at an end of the passage 7.

The transducing part (transducer) includes the acoustic element, and performs conversion between sound and an electrical signal. When the audio device is a device such as an earphone which sends sound, the transducing part outputs sound corresponding to an electrical signal (sound signal) input to the transducing part. When the audio device is a device such as a microphone which receives sound, the transducing part outputs an electrical signal (sound signal) corresponding to sound input to the transducing part. The details of the whole configuration of the transducing part including the configuration of the acoustic element are not particularly limited, and may be the same as those of known transducing parts.

The way of enclosing the transducing part in the housing, and the location of the transducing part in the housing, are not limited. The housing is formed of, for example, a metal, resin, glass, or composite thereof. The location and shape of the openings (including a sound transmission port) provided in the housing are not limited.

Examples of the audio device of the present invention include, but are not limited to, an earphone set, a headphone set, a microphone, a headset, a telephone receiver, a hearing aid, and a wearable terminal. The audio device of the present invention can be an acoustic evaluation device such as a sound level meter. The audio device of the present invention can be a unit of an audio device constructed of two or more units. The unit is, for example, an earphone unit, a headphone unit, a microphone unit, or a unit of a headset.

EXAMPLES

The present invention is not limited to the examples given below.

Example 1

There was prepared a commercially-available non-porous PET film (Track etched membrane manufactured by it4ip S.A. and having a thickness of 45 μm) having through holes formed to extend through the thickness of the film. The diameter of the through holes of the film was 3.0 μm, and the hole density of the film was $2.0\times10^6$ holes/cm$^2$.

Next, the PET film prepared was immersed in an etchant (an aqueous solution of 20 mass % potassium hydroxide) maintained at 80° C. for 30 minutes. After the etching, the film was taken out of the etchant, immersed and washed in RO water (water filtered through a reverse osmosis membrane), and then dried by a drying oven set at 50° C. Thus, a non-porous resin film having through holes formed to extend through the thickness of the film was obtained. The diameter of the through holes of the resin film obtained was 5.9 μm, and the area of the cross-section of each through hole taken perpendicular to the direction of the central axis of the hole was constant in the thickness direction of the film. The hole density remained unchanged before and after the etching.

Next, the dried resin film was dyed with a disperse dye. The dyed film appeared black to the naked eye.

Next, the black film thus fabricated was immersed in a liquid-repellent treatment solution for 3 seconds, and then left to dry at ordinary temperature for 30 minutes to form a liquid-repellent layer on the surfaces of the film and on the inner peripheral surfaces of the through holes. The liquid-repellent treatment solution was prepared by diluting a liquid-repellent agent (X-70-029C, manufactured by Shin-Etsu Chemical Co., Ltd.) with a diluent (FS thinner, manufactured by Shin-Etsu Chemical Co., Ltd.) to a concentration of 0.7 wt %.

The apparent density of the resin film (acoustic resistor) thus obtained was 0.70 g/cm$^3$.

Figure 14:
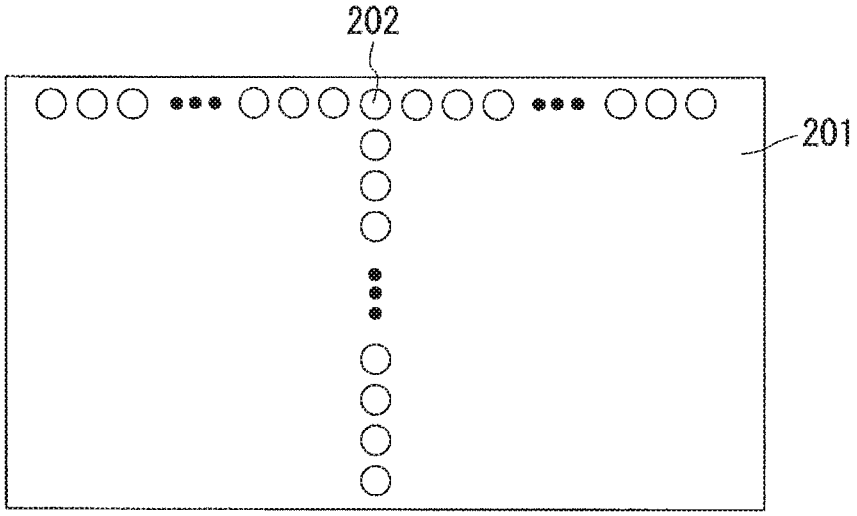
FIG. 14 is a diagram for illustrating measurement points on a sample in measurement performed in examples to determine the air permeability variation indices of acoustic resistors.

The variation in air permeability in the thickness direction of the resin film (acoustic resistor) thus obtained was evaluated by an air permeability variation index. The air permeability variation index was determined as follows. First, as shown in FIG. 14, a total of 40 measurement points 202 were set on a principal surface of the obtained resin film as a sample 201; specifically, 20 of the measurement points 202 were aligned in one direction and the other 20 were aligned in another direction orthogonal to the one direction. The air permeability in the thickness direction of the sample 201 was then measured at each measurement point 202 in terms of Gurley number according to JIS L 1096 B. Next, the average Av and standard deviation σ of the 40 measured values of air permeability were determined, and the air permeability variation index was determined as the ratio σ/Av of the standard deviation σ to the average Av. The air permeability variation index of the acoustic resistor fabricated in Example 1 was 0.081.

Comparative Example 1

A commercially-available non-woven fabric (Smash Y15250 manufactured by Asahi Kasei Fibers Corporation) was prepared as an acoustic resistor of Comparative Example 1. This non-woven fabric is made up of polyethylene terephthalate fibers formed by spunbonding and had an apparent density of 0.44 g/cm$^3$.

This acoustic resistor was used as a sample, for which the air permeability variation index was determined in the same manner as in Example 1. The locations of the measurement points 202 were the same as those in Example 1. The air permeability variation index of the acoustic resistor of Comparative Example 1 was 0.150.

The variation in air permeability of the acoustic resistor of Example 1 was smaller than that of the acoustic resistor of Comparative Example 1.

The present invention may be embodied in other forms without departing from the spirit or essential characteristics thereof. The embodiments disclosed in this specification are to be considered in all respects as illustrative and not limiting. The scope of the present invention is indicated by the appended claims rather than by the foregoing description, and all changes which come within the meaning and range of equivalency of the claims are intended to be embraced therein.

INDUSTRIAL APPLICABILITY

The acoustic resistor of the present invention can be used in any applications where conventional acoustic resistors have been used.

The invention claimed is:

1. An acoustic resistor for use in an audio device,
the audio device comprising:
a transducing part that performs conversion between sound and an electrical signal, the transducing part comprising an acoustic element that sends and/or receives the sound;
a housing enclosing the transducing part and having at least one opening; and
a passage for gas, the passage being present inside the housing and communicating with the at least one opening,
the acoustic element being placed in the passage,
the acoustic resistor being adapted to be placed between the at least one opening and the acoustic element in the passage, the acoustic resistor comprising a resin film having an air permeability in a thickness direction of the resin film,
the resin film being a non-porous film having through holes formed to extend straight through the resin film in the thickness direction, wherein
the through holes have a diameter of 3.0 μm or more and 13.0 μm or less, and
the acoustic resistor has an air permeability of 0.01 (sec/100 $cm^3$) or more and 1.0 (sec/100 $cm^3$) or less as expressed in terms of Gurley number measured according to JIS L 1096 B in the thickness direction of the acoustic resistor.

2. The acoustic resistor according to claim 1, wherein the acoustic resistor is placed to cover a cross-section of the passage.

3. The acoustic resistor according to claim 1, further comprising a liquid-repellent layer.

4. An acoustic resistor member comprising:
the acoustic resistor according to claim 1; and
a supporting member joined to the acoustic resistor.

5. An audio device comprising:
a transducing part that performs conversion between sound and an electrical signal, the transducing part comprising an acoustic element that sends and/or receives the sound;
a housing enclosing the transducing part and having at least one opening; and
a passage for gas, the passage being present inside the housing and communicating with the at least one opening,
the acoustic element being placed in the passage,
the audio device further comprising an acoustic resistor placed between the at least one opening and the acoustic element in the passage, the acoustic resistor comprising a resin film having an air permeability in a thickness direction of the resin film,
the resin film being a non-porous film having through holes formed to extend straight through the resin film in the thickness direction.

6. The audio device according to claim 5, wherein
the housing has the two or more openings,
the two or more openings include a sound transmission port for transmission of the sound between the acoustic element and the outside of the housing, and
the acoustic resistor is placed at least in the passage communicating with the opening other than the sound transmission port.

7. The audio device according to claim 5, being an earphone set, an earphone unit, a headphone set, a headphone unit, a headset, a headset unit, a telephone receiver, a hearing aid, or a wearable terminal.

8. The acoustic resistor according to claim 1, wherein a variation in air permeability of the acoustic resistor expressed by an air permeability variation index (σ/Av) is 0.3 or less.

9. An acoustic resistor for use in an audio device,
the audio device comprising:
a transducing part that performs conversion between sound and an electrical signal, the transducing part comprising an acoustic element that sends and/or receives the sound;
a housing enclosing the transducing part and having an opening at an outside surface of the housing; and
a passage for gas, the passage being present inside the housing and extending from the acoustic element to the opening,
the acoustic resistor being adapted to be placed between the opening and the acoustic element in the passage, the acoustic resistor comprising a resin film having an air permeability in a thickness direction of the resin film,
the resin film being a non-porous film having through holes formed to extend straight through the resin film in the thickness direction, wherein
the acoustic resistor is placed to cover an entire part of a cross-section of the passage.

10. The acoustic resistor according to claim 9, wherein the through holes have a diameter of 3.0 μm or more and 13.0 μm or less.

11. The acoustic resistor according to claim 9, further comprising a liquid-repellent layer.

12. An acoustic resistor member comprising:
the acoustic resistor according to claim 9; and
a supporting member joined to the acoustic resistor.

13. An acoustic resistor for use in an audio device,
the audio device comprising:
a transducing part that performs conversion between sound and an electrical signal, the transducing part comprising an acoustic element that sends and/or receives the sound, the transducing part including a frame;
a housing enclosing the transducing part and having at least one opening; and
a passage for gas, the passage being present inside the housing and communicating with the at least one opening,
the acoustic element being placed in the passage,
the acoustic resistor being placed between the at least one opening and the acoustic element in the passage so as to cover an aperture in the frame, the acoustic resistor comprising a resin film having an air permeability in a thickness direction of the resin film,
the resin film being a non-porous film having through holes formed to extend straight through the resin film in the thickness direction.

14. The acoustic resistor according to claim 13, wherein the through holes have a diameter of 3.0 μm or more and 13.0 μm or less.

15. The acoustic resistor according to claim 13, further comprising a liquid-repellent layer.

16. An acoustic resistor member comprising:
the acoustic resistor according to claim 13; and
a supporting member joined to the acoustic resistor.

* * * * *